US007766476B2

(12) United States Patent
Omori et al.

(10) Patent No.: US 7,766,476 B2
(45) Date of Patent: Aug. 3, 2010

(54) RECORDING PAPER MAGAZINE AND INK-JET PRINTER HAVING THE SAME

(75) Inventors: Hisashi Omori, Wakayama (JP); Eiji Motooka, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 544 days.

(21) Appl. No.: 11/529,325

(22) Filed: Sep. 29, 2006

(65) Prior Publication Data

US 2007/0081067 A1 Apr. 12, 2007

(30) Foreign Application Priority Data

Oct. 6, 2005 (JP) ..... 2005-293317

(51) Int. Cl.
*B41J 29/13* (2006.01)

(52) U.S. Cl. ..... 347/108

(58) Field of Classification Search ..... 347/108, 347/347; 358/1.13, 1.18, 1.16; 271/145
See application file for complete search history.

(56) References Cited

U.S. PATENT DOCUMENTS 5,653,435 A * 8/1997 Yoneda ..... 271/145
5,944,306 A * 8/1999 Maeda et al. ..... 271/145
2002/0060260 A1* 5/2002 Imai et al. ..... 242/348.4

FOREIGN PATENT DOCUMENTS

| | | | |
|---|---|---|---|
| JP | 08-197849 | A | 8/1996 |
| JP | 09-290937 | A | 11/1997 |
| JP | 10-029355 | A | 2/1998 |
| JP | 10-171031 | A | 6/1998 |
| JP | 2000-159365 | A | 6/2000 |
| JP | 2001-253566 | A | 9/2001 |

* cited by examiner

*Primary Examiner*—Stephen D Meier
*Assistant Examiner*—Alexander C Witkowski
(74) *Attorney, Agent, or Firm*—Global IP Counselors

(57) ABSTRACT

A photographic printing device includes an ink-jet printer with recording paper magazine. The recording paper magazine includes a housing and a humectant. The housing is configured to receive a recording paper. The humectant is provided in order to moisturize the inside of the housing of the magazine. The humectant is preferably placed at an upper portion of the magazine in order to allow efficient moisture transfer by way of natural convection.

6 Claims, 5 Drawing Sheets

RECORDING PAPER MAGAZINE AND INK-JET PRINTER HAVING THE SAME

CROSS-REFERENCE TO RELATED APPLICATIONS

This application claims priority under 35 U.S.C. §119 to Japanese Patent Application No. 2005-293317 filed on Oct. 6, 2005. The entire disclosure of Japanese Patent Application No. 2005-293317 is hereby incorporated herein by reference.

BACKGROUND OF THE INVENTION

1. Field of the Invention

The present invention relates to a recording paper magazine for accommodating a roll-type recording paper and an ink-jet printer having the same.

2. Background Data

In ink-jet printers and photographing processing apparatuses, ink-jet print sheets, print sheets, etc., as recording members generally change their characteristics according to ambient environmental conditions (temperature and humidity), and finished quality of the print and the printed letter is changed according to the characteristics. Thus, the finished quality of the printed images and the printed letter may vary widely.

As a means of solving these problems, it has been proposed that the recording members are improved by developing materials independent of the environment, or that the environmental conditions inside a magazine for accommodating the recording member is kept constant. In Japanese Patent Publication No. JP H10-171031, for example, the way is disclosed in which temperature and humidity are controlled so as to be kept constant by providing a humidifying system, a heater, and a sensor inside the recording paper magazine.

However, these conventional recording paper magazines described above also have problems as described below.

Specifically, the above-described recording paper magazine of Japanese Patent Publication No. JP H10-171031 constituted so as to keep the environmental condition constant has exceptionally high-performance, and is expensive for actual installation.

Additionally, in the ink-jet printers, cracks of an ink receiving layer of the ink-jet print sheet in a low humidity environment, so called "cracks", occur, resulting in deterioration of the print quality. However, these problems do not need such an exact management of humidity shown in the Japanese Patent Publication No. JP H10-171031, and it is only necessary to keep the humidity conditions within a predetermined range in order to prevent the above-described phenomenon from occurring.

SUMMARY OF THE INVENTION

The object of the present invention is to provide a recording paper magazine and an ink-jet printer having the same which are able to keep a humidity environment inside the recording paper magazine within a predetermined range at a low price, and which are able to prevent the cracks of the recording papers from occurring.

A recording paper magazine according to a first aspect of the present invention comprises a housing, and a humectant. The housing accommodates a recording paper inside thereof. The humectant is placed at an upper portion of the housing for moisturizing a space in the housing. In other words, the housing is configured and arranged to receive recording paper therein and the humectant is positioned in the housing in order to moisturize a space in the housing.

Here, the humectant is provided for moisturizing the inside of the housing accommodating the recording paper, and the humectant is placed at the upper portion of the housing for efficiently moisturizing by way (means) of natural convection.

It is noted that the humectant is one having a humidity control function which shows desorption in a low humidity environment and absorption in a high humidity environment. Also, the recording paper magazine according to the present invention includes one detachable from an ink-jet printer main body in the ink-jet printer, and a space sectioned within the ink-jet printer for accommodating the recording paper inside of the ink-jet printer main body.

Here, for the ink-jet print sheet, moisture contained in an ink absorbing layer which is called "ink receiving layer" and constitutes the print sheet is released in the low humidity. When the print sheet being in short of the moisture is conveyed to the printer, a fissure occurs in the ink receiving layer, that is, so-called "cracks" occur. Then, if printing is done on the ink-jet print sheet with the cracks, a difference in color development between the cracking part and the non-cracking part occurs when applying ink, and might look like a flaw.

In order to prevent the above-described cracks of the ink receiving layer from occurring, a conventional technique has been proposed of keeping the environment within the recording paper magazine constant by means of a humidifying system, which includes various sensors, etc. However, such a recording paper magazine having a means for keeping the humidity constant has exceptionally high-performance and is expensive. It is not necessary to strictly control the humidity to be constant in order to prevent the cracks of the ink receiving layer as described above, but it is only necessary to control the humidity to the extent that the humidity is not below a predetermined amount.

Now, in the recording paper magazine according to the present invention, the humectant is utilized as a means for moisturizing the inside of the housing accommodating the recording paper to the extent that it is not below a predetermined humidity. Furthermore, the humectant is placed at an upper portion of the housing.

Thus, it becomes easily possible to keep the humidity inside the housing for accommodating the recording paper at a desired condition without mounting a high-performance mechanism utilizing a humidifying system, various sensors, etc. Also, release of the moisture contained in the ink receiving layer of the recording paper never occurs. Furthermore, the humectant is placed at the upper portion of the housing, so that it becomes possible to efficiently assure the humidity conditions inside the entire housing by way (means) of natural convection. That is, a convection phenomenon is employed, in which the air around the humectant, which is moisturized and has a high specific gravity due to the moisturizing action of the humectant, moves downwardly, and the air having a low specific gravity due to drying moves upwardly, efficiently keeping the inside of the housing at proper humidity.

As a result, the humidity environment within the recording paper magazine can be kept within a predetermined range at a low price, capable of preventing the cracks of the recording papers from occurring.

A recording paper magazine according to a second aspect of the present invention is the recording paper magazine according to the first aspect, and further comprises an openable and closable magazine cover on a top of the housing.

Then, the humectant is attached to the inside of the magazine cover with an adhesive member.

Here, the humectant is attached to the inside of the openable and closable magazine cover with an adhesive, an adhesive tape, or the like as an adhesive member.

It is noted that the adhesive member is one utilizing adhesion obtained from synthetic rubber in low hardness, such as an adhesive and an adhesive tape, for example.

Also, the humectant generally has an effective life, and after end of the effective life, moisturizing action will be reduced. Thus, for the purpose of retaining the humidity conditions inside the housing as descried above, the humectant has to be replaced before the end of the period.

Accordingly, the humectant can be replaced easily by opening and closing the magazine cover, so that even though replacement of the humectant may occur often, it is possible to reduce a work load on the user.

A recording paper magazine according to a third aspect of the present invention is the recording paper magazine according to the first aspect, and further comprises an openable and closable casing for storing the humectant at the upper portion of the housing. Also, the casing has a porous structure at a part facing the inside of the housing.

Here, a casing for storing the humectant is further provided, and the casing is openable and closable for replacement of the humectant. Furthermore, the part facing the inside of the housing has a porous structure to thereby allow the air to flow between the inside of the housing and the casing.

Thus, the user can easily replace the humectant by means of the openable and closable casing without removing the magazine cover. Also, if the humectant is replaced by leaving the magazine cover with a relatively large area open, the humidity environment assured inside of the magazine becomes equal to the outside air. However, if the replacement is performed by opening the casing smaller in area than the magazine cover, the humidity environment is never equal to the outside air during the time required to open it for replacement.

As a result, it is possible to reduce a work burden on the user in replacement of the humectant, and it is also possible to assure the humidity environment inside of the magazine during the replacement, capable of reducing consumption of the humectant.

An ink-jet printer according to a fourth aspect of the present invention comprises a recording paper magazine, a conveyance path unit, and a print unit. The recording paper magazine is the recording paper magazine according to any one of the first to third aspects of the present invention. The conveyance path unit has a plurality of rollers configured and arranged to convey (for conveying) the recording paper. The print unit is configured and arranged to print an image on the recording paper. Also, the recording paper magazine is placed at a position lower than the print unit.

It is noted that the recording paper magazine in the present invention includes one detachable from the ink-jet printer main body, and a space sectioned inside the ink-jet printer for accommodating the recording paper within the ink-jet printer main body.

Now, in the ink-jet printer having the recording paper magazine according to any one of the first to third aspects of the present invention, a recording paper magazine is placed at a position vertically lower than the print unit for printing an image on the recording paper.

It is noted that "high" and "low" here mean positions in the vertical direction when the ink-jet printer is set.

In the print unit in the ink-jet printer, printing is done on the print surface of the print sheet facing approximately upward in the vertical direction for stabilizing the fixation of the ink. Thus, in the conveyance path unit of the ink-jet printer having the recording paper magazine at a position lower than the print unit, the recording paper upwardly drawn from the recording paper magazine is wound around the roller to thereby change the conveyance direction into an approximately horizontal direction. At this time, the surface of the recording paper to be conveyed opposite of the print surface (hereinafter referred to as "base surface") is wound around the roller, and the base surface of the recording paper is subjected to a compressive stress while the print surface is subjected to a tensile stress. Furthermore, the tensile stress encourages the cracks to occur in the above-described low humidity environment.

Thus, the ink-jet printer according to the present invention has the recording paper magazine according to any one of the first to third aspects of the present invention.

Accordingly, since the recording paper kept in a moisturized state is conveyed, even when it is wound around the roller through the conveyance path to cause a tensile stress on the print surface, it is possible to suppress so called cracks. Thus, it is possible to reduce occurrence of failures of the printed image looking like a flaw due to the difference in color development at the cracking portion.

As a result, even in a low humidity environment, it is possible to prevent the failure of the printed image due to the cracks, etc., from occurring, thus providing a high-quality printing.

An ink-jet printer according to a fifth aspect of the present invention comprises a recording paper magazine, a conveyance path unit, a print unit, and a direction change unit. The recording paper magazine is one according to any one of the first to third aspects of the present invention. The conveyance path unit has a plurality of rollers configured and arranged to convey (for conveying) the recording paper. The print unit is configured and arranged to print an image on the recording paper. The direction change unit is located upstream of the print unit, and includes a roller in the conveyance path unit around which a base surface of the recording paper opposite of a print surface is wound.

It is noted that the recording paper magazine according to the present invention includes one detachable from the ink-jet printer main body, and a space sectioned inside of the ink-jet printer for accommodating the recording paper in the ink-jet printer main body.

Here, in the ink-jet printer having a recording paper magazine according to any one of the first to third aspects of the present invention, the direction change unit, including a roller around which the base surface of the recording paper is wound, is located upstream of the print unit.

In this case, in the ink-jet printer, since the direction change unit changes the conveyance direction by winding the base face of the recording paper transported around the roller after being drawn out of the recording paper magazine, the print surface is subjected to a tensile stress, thereby developing the cracks that are generated in the above-described low humidity environment.

Thus, the recording paper is transported in a humidity retention state, so that so called cracks are reduced, even if the print surface at the direction change unit is subjected to the tensile stress. Consequently, it is possible to prevent the failure of the print image looking like a flaw due to the difference in color development at the crack portion.

As a result, even in a low humidity environment, it is possible to prevent the failure of the print image due to the cracks from occurring, thereby providing a high-quality print.

BRIEF DESCRIPTION OF THE DRAWINGS

Referring now to the attached drawings which form a part of this original disclosure.

DETAILED DESCRIPTION OF THE PREFERRED EMBODIMENTS

First Embodiment

Set out below is a photographic printing device 1 having a magazine set unit 30 (recording paper magazine) according to one embodiment of the present invention with reference to FIG. 1 through FIG. 4.

Entire Configuration of the Photographic Printing Device 1

Figure 1:
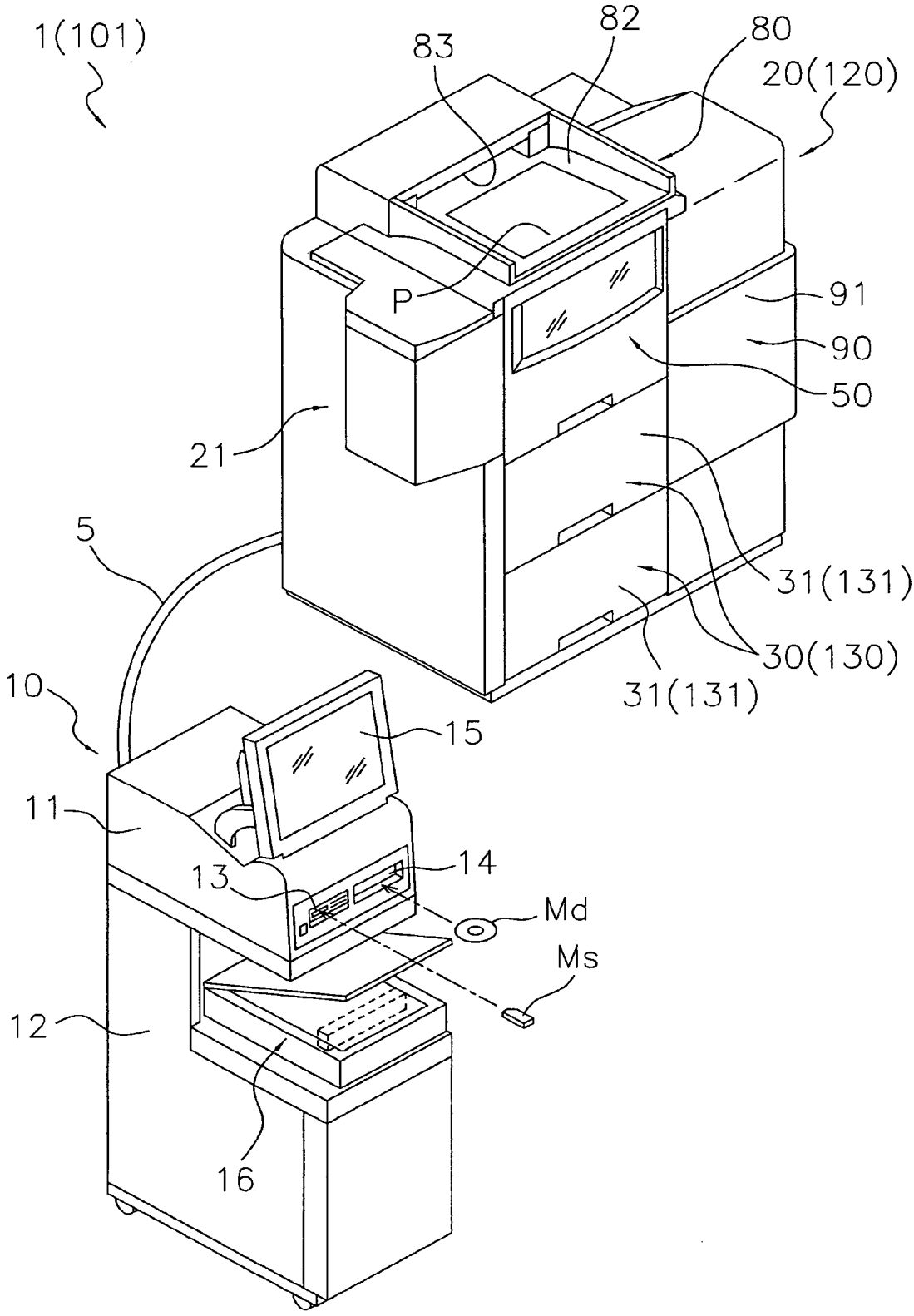
FIG. 1 is an appearance view of the photographic printing device including the recording paper magazine according to one embodiment of the present invention.

The photographic printing device 1 according to one embodiment of the present invention is a photographic printing device for printing an input image with pigment ink, and includes an accepting block 10 and an ink-jet printer 20 as shown in FIG. 1.

Configuration of the Accepting Block 10

The accepting block 10 is an apparatus for obtaining image data and order information, and performing a necessary correction process, etc. The accepting block 10 includes an accepting device 11, a display 15, and a flatbed scanner 16 as shown in FIG. 1.

The accepting device 11, which is placed on a wagon-type frame 12, is provided with a semiconductor drive 13 for reading image data stored in a recording medium Ms formed of a flash memory, and a disk drive 14 for reading image data stored in a disk-type recording medium Md, such as a CD-R, a DVD, or the like.

The display 15 has a display screen with a touch panel, and is formed of a liquid crystal display.

The flatbed scanner 16 is provided at the middle position in the vertical direction of the frame 12, and captures an image of an object to be scanned as color-separated image data of R (red), G (green), and B (blue).

Configuration of the Ink-Jet Printer 20

The ink-jet printer 20 prints the image data transmitted from the accepting block 10 via a communication cable 5 on a print sheet (recording paper) P on the basis of the order information. Then, the ink-jet printer 20 consists of two magazine set units 30, a print unit 50, a discharge unit 80, and an ink reservoir 90 as shown in FIG. 1 and FIG. 2.

Figure 2:
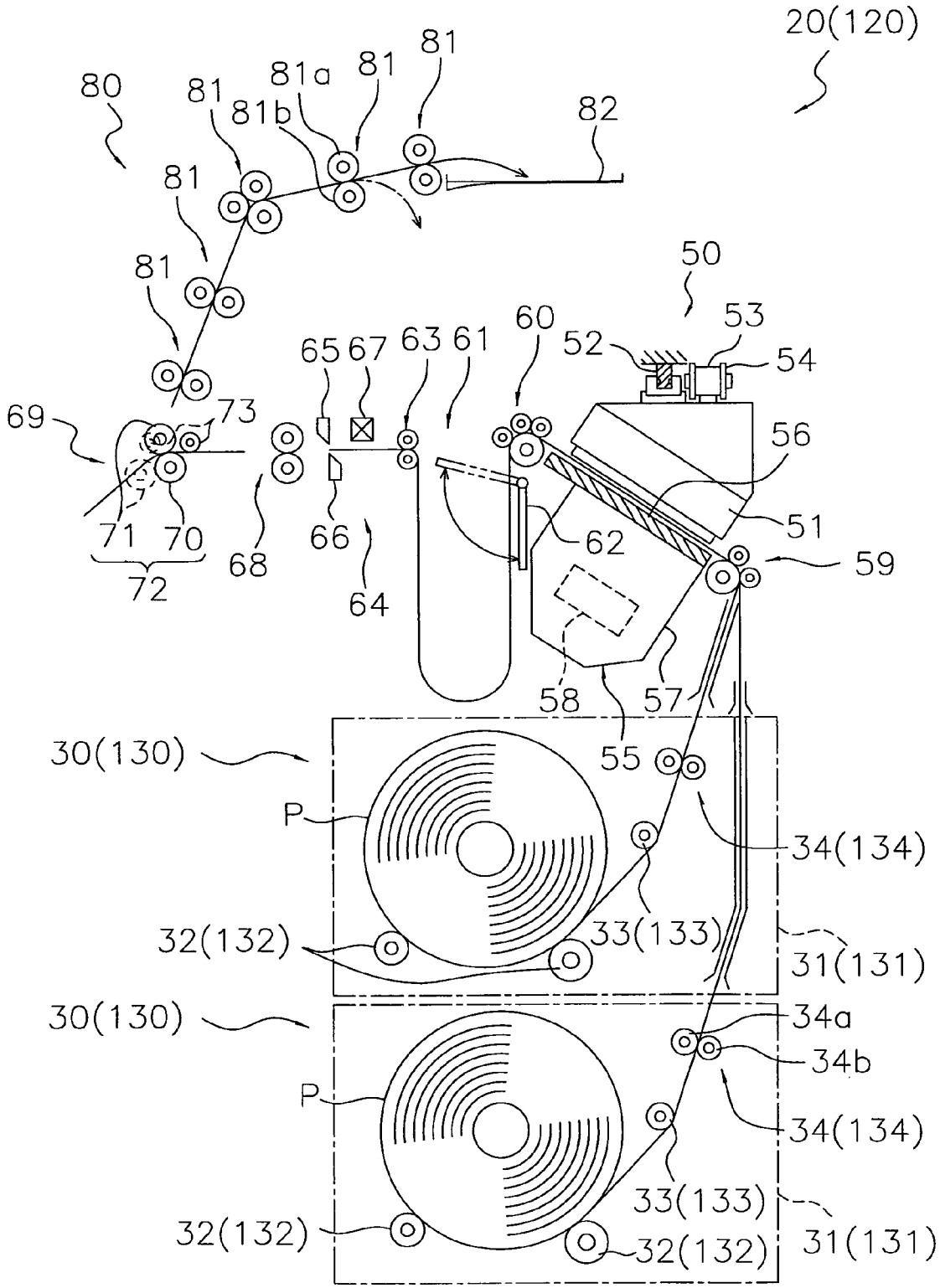
FIG. 2 is an internal structural view of the ink-jet printer of the photographic printing device shown in FIG. 1.

The magazine set unit 30 is a unit for accommodating and holding a roll-type print sheet P, and two of them are placed at a lower portion of a printer main body 21 as shown in FIG. 1 and FIG. 2. The magazine set unit 30 has a magazine (housing) 31, and a conveyance mechanism (support rollers 32, a guide roller 33, a pair of pressing conveyance rollers 34, etc). A configuration except for the conveyance mechanism will be described later.

The magazine 31 is configured so as to accommodate and hold a roll-type print sheet P inside thereof. The print sheet P is rolled such that the print surface faces outward.

The support rollers 32 apply a torque to the print sheet P accommodated in the magazine 31.

The guide roller 33 guides the print sheet P through a conveyance path.

The pair of pressing conveyance rollers 34 conveys the print sheet P in a conveyance direction by pinching it between two opposing rollers 34*a* and 34*b*, and sends it to the print unit 50.

The print unit 50 is placed in the center and on an upper portion of a printer main body 21 as shown in FIG. 2, and is a unit for printing image data on a print sheet P, and cutting it to a desired size. The print unit 50 includes a print head 51, a guide rail 52, a driving belt 53, a paper supporting unit 55, a group of pressing conveyance rollers (conveyance path unit, direction change unit) 59, a group of pressing conveyance rollers 60, a loop forming unit 61, a cutter unit 64, and an inverting unit 69.

The print head 51 spits or shoots ink on the print sheet P to form an image.

The guide rail 52 guides the print head 51 in a direction perpendicular to the width direction.

The driving belt 53 is wound around a pulley 54, and is provided for reciprocating the print head 51 along the guide rail 52.

The paper supporting unit 55 absorbs and holds the print sheet P at a position suitable for printing by the print head 51. Also, the paper supporting unit 55 includes a print table 56 formed with a plurality of holes extending in the thickness direction and formed symmetrically in the width direction, and a fan 58 mounted in a support member 57 for applying a negative pressure to the print sheet P via the holes on the print table 56.

The groups of pressing conveyance rollers 59 and 60 are respectively placed upstream and downstream of the conveyance direction of the paper supporting unit 55, and each of them are arranged side by side in the width direction. The group of pressing conveyance rollers 59 consists of a roller 59*a*, a roller 59*b*, and a roller 59*c*.

The loop forming unit 61 includes a guide plate 62 located downstream of the group of pressing conveyance rollers 60, and a pair of pressing conveyance rollers 63 for conveying the print sheet P guided by the guide plate 62. The guide plate 62 can be switched from a horizontal posture shown by two-dotted lines to an open posture shown by the solid line as shown in FIG. 2 to thereby allow the print sheet P to hang down and form a loop.

The cutter unit 64 comprises a stationary knife 65, a moving knife 66, a cut-position sensor 67 with a reflective sensor, and a pair of pressing conveyance rollers 68 for launching out the print sheet P.

The inverting unit 69 comprises a driving roller 70 to convey the print sheet P, a driven roller 71 to compressively sandwich the print sheet P with the driving roller 70, a switching mechanism (not illustrated) to switch directions of the pair of operation rollers 72 consisting of the driving roller 70 and the driven roller 71, and a guide roller 73 which is rotatably disposed on the print surface side of the print sheet P. The pair of operation rollers 72 is displaced by the switching mechanism to a position indicated by dashed lines shown in FIG. 2 while pinching the conveyed print sheet P. Then, the pair of operation rollers 72 is rotated in a reverse direction to change the conveyance direction of the print sheet P.

The discharge unit 80 is a conveyance path for conveying to a copy receiving tray 82 the print sheet P which is formed with an image using the print unit 50 and has already been cut, and is a receiving unit for receiving the discharged print sheet P as shown in FIG. 1 and FIG. 2. The discharge unit 80 has a plurality of pairs of pressing conveyance rollers 81 and the copy receiving tray 82.

The pair of pressing conveyance rollers 81 conveys the print sheet P in the conveyance direction and launches out it to the copy receiving tray 82 by pinching it between the two opposing rollers 81*a* and 81*b*.

The copy receiving tray 82 is placed adjacent to an outlet 83 for discharging the print sheet P to the outside (externally) of the ink-jet printer 20, and receives the print sheet P discharged from the outlet 83.

The ink reservoir 90 is detachably attached into a wall body 91 as shown in FIG. 1, and contains seven ink cartridges (not illustrated) different in hue. These ink cartridges can be replaced with a new ink cartridge by being attached to or detached from it. The respective ink cartridges are charged with yellow (Y), magenta (M), cyan (C), black (K), red (R), violet (V) and transparent (CL) inks. Also, the wall body 91 is constituted so as to be openable and closeable about an axis extending in the vertical direction.

Magazine Set Unit 30

Figure 3:
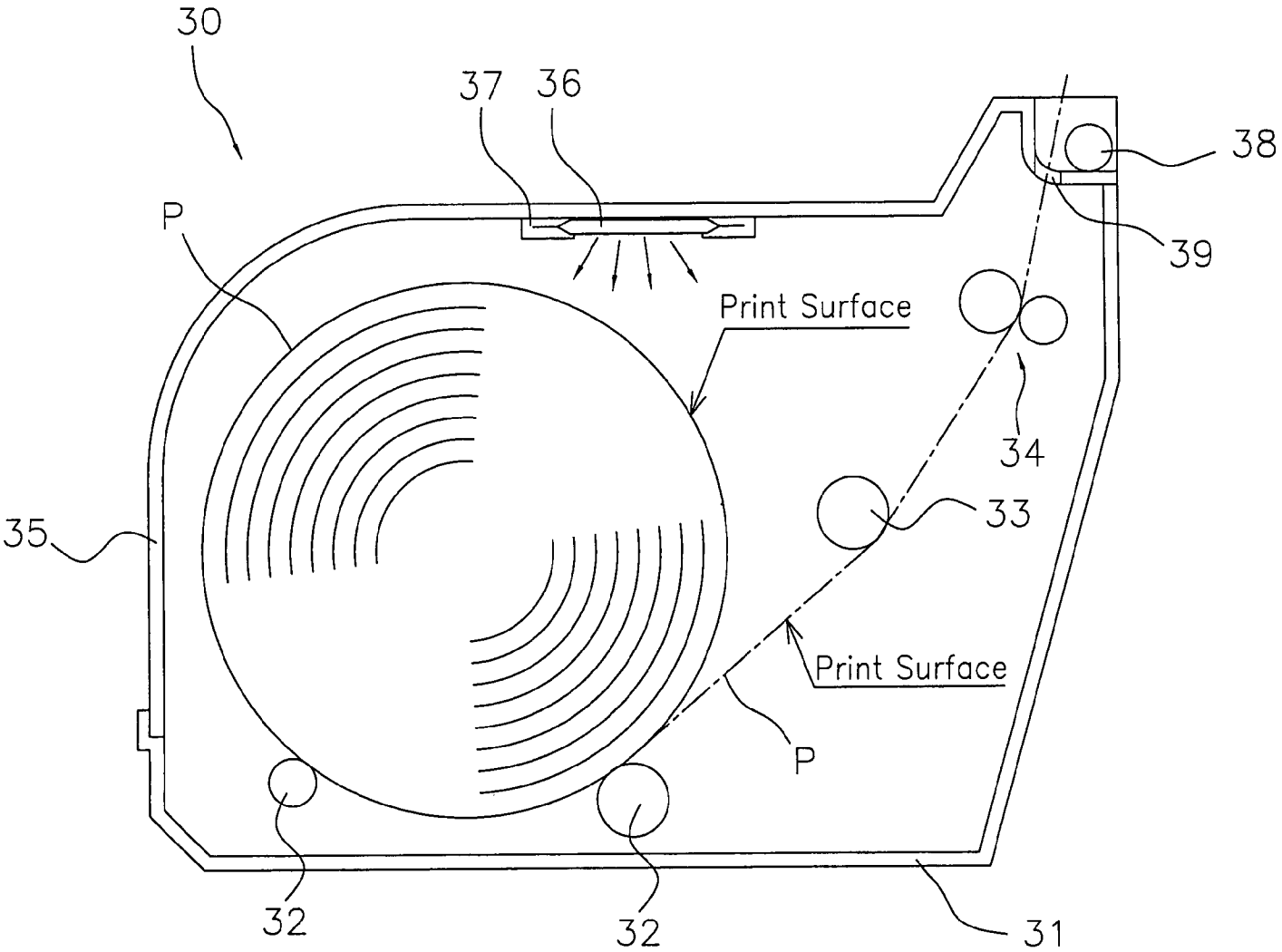
FIG. 3 is a cross-sectional view showing the magazine included in the ink-jet printer shown in FIG. 2.

In order to prevent cracks of a print sheet P in a low humidity environment, the magazine set unit 30 has a magazine 31, a magazine cover 35, a humectant 36, an adhesive tape (adhesive member) 37, a shutter 38, a outlet 39 as members as well as the conveyance mechanism or means (32, 33, and 34) as shown in FIG. 3.

The print sheet P accommodated in the magazine set unit 30 is rolled such that the print surface faces outside (radially outwardly), and in this embodiment, the print sheet P having use conditions of temperature of 15 to 30 degrees Celsius, and of humidity of 30% to 75%, for example, is employed. The print sheet P is made up of a gloss layer forming a top surface, an ink receiving layer made of aluminum silicate for absorbing ink, and a base layer as a base material in this order from the print surface. The print sheet P might be cracked on the print surface, that is, so-called "cracks" may occur due to release of moisture contained in the ink receiving layer if used in an environment that does not satisfy the humidity conditions mentioned above.

The magazine cover 35 is placed on a top of the magazine 31, and is constructed to be openable and closable with respect to the magazine 31 for replacement of the print sheet P or the humectant 36.

The humectant 36 has an effect of moisturizing the inside of the magazine to such an extent that a failure of the print sheet P does not occur even if the print sheet P is used in humidity conditions that does not satisfy the use conditions. For example, if the print sheet P to be utilized in this embodiment is one described above, the humectant 36 can assure a humidity of 30% or more. Also, the humectant 36 has an effective life decided as a rough guide for assuring the above-mentioned humidity conditions, and therefore, should be replaced with a new humectant 36 at a proper timing. Furthermore, the humectant 36 is placed at the upper portion of the magazine 31, so that a convection phenomenon occurs in which the air around the humectant 36 containing moisture and having a high specific gravity due to the effect of the humectant 36 moves downwardly, and the air having a lower specific gravity due to drying moves upwardly, efficiently maintaining a proper humidity inside of the magazine 31.

The adhesive tape 37 is for attaching the humectant 36 to the magazine cover 35, and this makes it possible for the user to easily attach the humectant 36. Additionally, if adhesion obtained from synthetic rubber in low hardness is employed, the tape can repeatedly be used for multiple replacements, allowing a user to replace only the humectant 36, which is more advantageous.

The shutter 38 can be switched between a close state where it covers the front surface of the outlet 39 in a light-tight manner and an open state where the outlet 39 is exposed such that the print sheet P can be drawn out. Then, in the close state, packing not shown placed between the outlet 39 and the shutter 38 can prevent natural light and humidity from entering the magazine 31.

Features of the Photographic Printing Device 1 According to the First Embodiment (1)

In the photographic printing device 1 according to this embodiment, the humectant 36 is provided for moisturizing the inside of the magazine 31, i.e. a space accommodating the print sheet P. Furthermore, the humectant 36 is provided at the upper portion of the magazine 31 for efficient moisturizing by means of natural convection.

Now, the print sheet P, which is utilized in the photographic printing device 1 according to this embodiment, a phenomenon, the so-called "cracks", in a low humidity environment of 30% or less. Supposing that printing is done on the print sheet P with the cracks, a fault looking like a flaw might occur.

However, with the present invention it is possible to keep the humidity inside the magazine 31 accommodating the print sheet P 30% or more without mounting high-performance mechanisms utilizing a humidifying system and various sensors. Thus, the humectant 36 is provided at the upper portion of the magazine 31, so that the entire humidity conditions inside the magazine 31 can be efficiently assured by means of natural convection.

Furthermore, the elimination of the humidifying system, various sensors, etc., as a means for keeping the humidity under a certain condition offers a weight reduction of the magazine set unit 30.

As a result, it becomes possible to keep the humidity environment within the magazine 31 30% or more at a low price, preventing the cracks of the print sheet P from occurring. Owing to the weight reduction of the magazine set unit 30, a user can replace the recording paper with less work burden.

(2)

In the photographic printing device 1 according to this embodiment, the humectant 36 is attached to the inside of the magazine cover 35 with the adhesive tape 37 as an adhesive member.

With the humectant 36 employed in the photographic printing device 1 according to this embodiment, since less moisturizing performance is achieved with time, the humectant 36 has an effective life for keeping the humidity inside the magazine 31 30% or more. The effective life is 10 to 14 days. It is noted that the humidity does not drop drastically after the end of the effective life, but gradually drops. Therefore, in order to assure the humidity conditions inside of the above-described magazine 31, it is desirable to replace the humectant 36 within the period.

Owing to the tape, the humectant 36 can be attached easily, and therefore, the user can make a replacement with a lighter burden at relatively shorter intervals like 10 to 14 days. For the reusable adhesive tape 37 allowing multiple replacements, it is possible to replace it like replacement of only the humectant 36, which is more advantageous.

(3)

In the photographic printing device 1 according to this embodiment, the magazine set unit 30 is placed at a position vertically lower than the print unit 50 for forming a printed image on the print sheet P.

Figure 4:
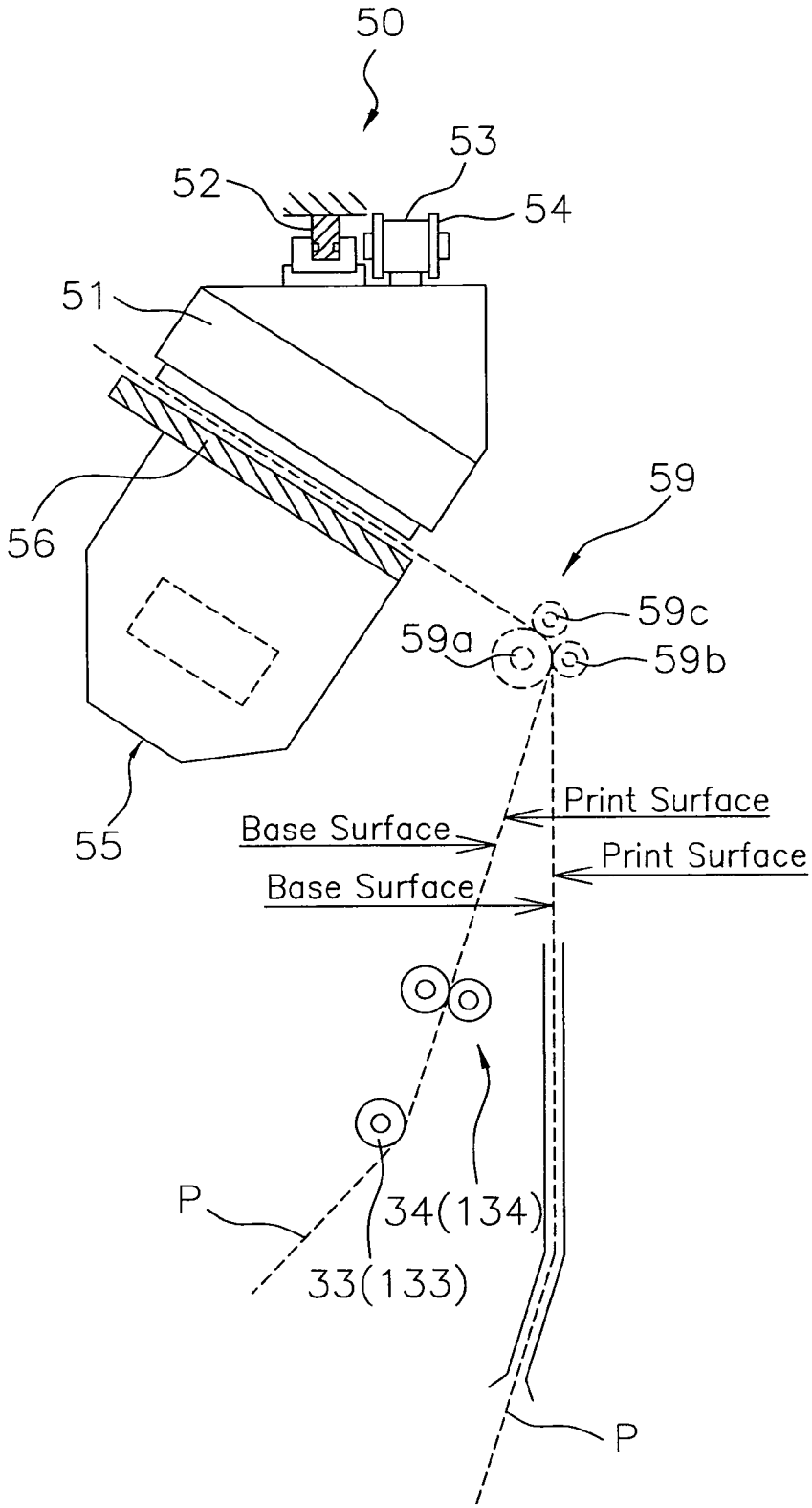
FIG. 4 is an enlarged cross-sectional view around the group of pressing conveyance rollers 59 included in FIG. 2.

Now, in the print unit 50 in the photographic printing device 1 according to this embodiment, printing is done on the print surface of the print sheet P approximately facing upward for stabilizing the fixation of ink as shown in FIG. 2. Thus, in the photographic printing device 1 according to this embodiment having the magazine set unit 30 at a position lower than the print unit 50, the group of pressing conveyance rollers 59 for winding the print sheet P that is upwardly drawn from the magazine set unit 30 around the roller is required to change the conveyance directions. At this time, the base surface of the print sheet P to be conveyed is wound around the roller 59*a*, and the base surface of the print sheet P is subjected to a compressive stress while the print surface is subjected to a tensile stress as shown in FIG. 4. Furthermore, the tensile stress encourages the cracks to occur in the above-described low humidity environment.

However, since the print sheet P kept in a moisturized state according to the present invention is conveyed, even when it is wound around the roller 59*a* through the conveyance path to cause a tensile stress on the print surface, the cracks never occur. Thus, it is possible to reduce occurrence of a failure of the printed image looking like a flaw due to the difference in color development at the cracking portion.

As a result, even in the low humidity environment of 30% or less, it is possible to prevent a failure of the printed image due to the cracks from occurring, and it becomes possible to provide a high-quality printing.

(4)

In a conveyance path in the photographic printing device 1 according to this embodiment, the group of pressing conveyance rollers 59 including the roller 59*a* around which the base surface of the print paper P is wound is located upstream of the print unit 50 as shown in FIG. 4.

Here, in the photographic printing device 1 of the present embodiment, since the base face of the printing paper P drawn out of the magazine set unit 30 and transported is wound around the roller 59*a* of the group of pressing conveyance rollers 59, the print surface is subjected to a tensile stress, thereby to develop the cracks that are generated in the above-described low humidity environment.

However, since the print paper P retaining moisture according to the present invention is transported, even if the print surface is subjected to a tensile stress when the paper is wound around the roller 59*a* in the conveyance path, the cracks never occur. Accordingly, it is possible to prevent a failure of the print image looking like a flaw due to a difference in color development at the crack portions.

As a result, it is possible to prevent a failure of the print image due to the cracks in the low humidity environment of 30% or less, thereby to provide a high-quality printing.

Second Embodiment

Set out below is a photographic printing device 101 having a magazine set unit 130 (recording paper magazine) according to one embodiment of the present invention with reference to FIG. 5. Here, a description is made on only the magazine set unit 130 different from the above-described first embodiment, and the components not described conform to the first embodiment.

Magazine Set Unit 130

Figure 5:
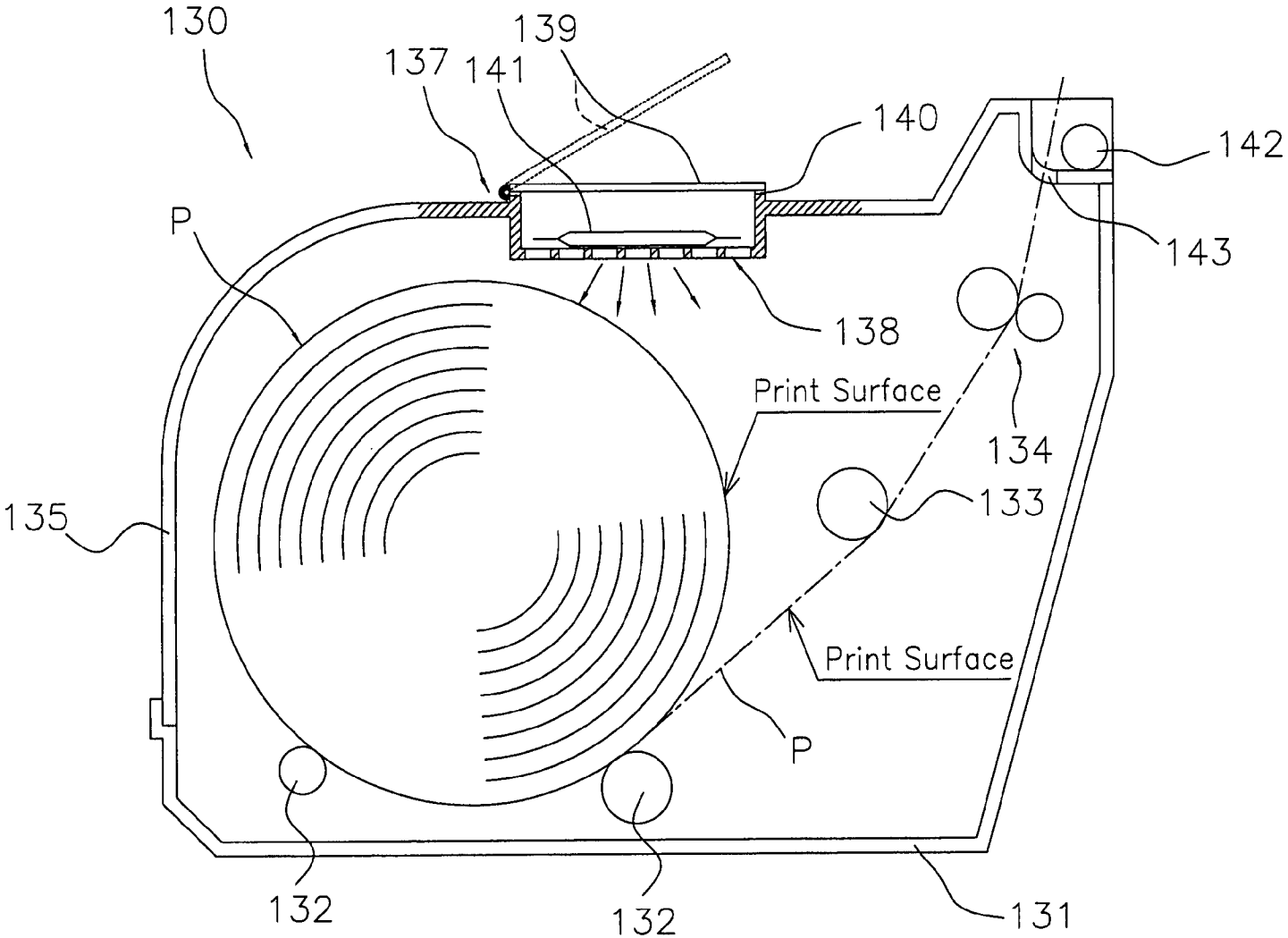
FIG. 5 is a cross-sectional view of the magazine included in the inkjet printer according to another embodiment of the present invention.

In order to prevent the cracks of print sheet P from occurring in the low humidity environment, the magazine set unit 130 includes a magazine (housing) 131, a magazine cover 135, a casing 137, a humectant 141, a shutter 142, and an outlet 143 as members except for conveyance means (132, 133, and 134) as shown in FIG. 5.

Additionally, the magazine set unit 130 includes support rollers 132, a guide roller 133, and a pair of rollers 134 as members except for conveying means.

In this embodiment again, the print sheet P is employed similarly to the first embodiment, having use conditions of temperature of 15 to 30 degrees Celsius, and of humidity of 30% to 75%, and being made up of a gloss layer, an ink receiving layer, and a base layer. Accordingly, if the print sheet P is used in the environment that does not satisfy the humidity conditions, a phenomenon of cracks might occur.

The magazine cover 135 is placed on a top of the magazine 131, and is constructed to be openable and closable with respect to the magazine 131 for replacement of the print sheet P.

The casing 137 is a small space for storing the humectant 141 to moisturize the inside of the magazine, and comprises a porous surface 138 facing the inside of the magazine 131 and an openable and closable open-and-close member 139 facing the outside of the magazine 131.

The porous surface 138 is constructed to aerate the air moisturized by the humectant 141 stored in the casing 137 to the inside of the magazine 131.

The open-and-close member 139 is for replacing the humectant 141, and is large enough to remove the humectant 141. The humectant 141 has an effective life decided as a rough guide for assuring the humidity conditions as described before, and therefore, has to be replaced with a new humectant 141 at a proper timing by opening and closing the open-and-close member 139. Packing 140 is provided at the contact portion between the open-and-close member 139 and the casing 137, and prevents natural light and humidity from entering the casing 137.

Similarly to the first embodiment, the humectant 141 has an effect of moisturizing the inside of the magazine to such an extent that the cracks do not occur on the print sheet P if the print sheet P is used under humidity condition that does not satisfy the use conditions, and can assure the humidity of 30% or more. The humectant 141 is stored in the casing 137 placed at the upper portion inside of the magazine 131, so that a convection phenomenon occurs in which the air around the humectant 141 which includes the moisture to increase the specific gravity due to the effect of the humectant 141 moves downwardly through the porous surface 138, and the air having the lower specific gravity due to drying moves upwardly, efficiently keeping the inside of the magazine 131 at proper humidity.

The shutter 142 can be switched between a close state where it covers the front surface of the outlet 143 in a light-tight manner and an open state where the outlet 143 is exposed such that the print sheet P can be drawn out. Then, in the close state, packing not shown placed between the outlet 143 and the shutter 142 can prevent the natural light and humidity from entering the magazine 131.

Features of the Photographic Printing Device 101 According to the Second Embodiment (1)

In the photographic printing device 101 according to this embodiment, the casing 137 for storing the humectant 141 is provided. The casing 137 has the openable and closable open-and-close member 139 at a part facing the outside of the magazine for replacing the humectant 141, and the porous surface 138 at a part facing the inside of the magazine 131 for allowing air to freely flow between the inside of the magazine 131 and the casing 137.

Thus, the user can easily replace the humectant 141 by means of the open-and-close member 139 with a relatively small area provided on the casing 137 without removing the magazine cover 135. Also, if the humectant 141 is replaced by removing the magazine cover 135, since the area of the magazine cover 135 is generally large, the humidity environment assured inside of the magazine 131 becomes equal to that of the outside air because of leaving the magazine cover 135 open through the replacement operation. However, if the replacement is performed by opening the open-and-close member 139 smaller in area than the magazine cover 135, the humidity environment assured inside of the magazine 131 does not become equal to that of the outside air due to the opening through the replacement operation. Furthermore, it is not necessary to use the adhesive tape 37, etc., described in the first embodiment, which makes the replacement easier.

As a result, it is possible to reduce a load imposed on the user in replacement of the humectants 141, and it is also possible to assure the humidity environment inside of the magazine 131 during the replacement, capable of reducing consumption of the humectant 141.

Other Embodiments

While the description is made on the first and second embodiments according to the present invention, the present invention is not limited to the above-described embodiments, and various changes and modifications can be made herein without departing from the scope of the invention.

(A)

In the photographic printing devices 1 and 101 according to the above-described first and second embodiments, descriptions as to the humectants 36 and 141 placed at the upper portion of the magazines 31 and 131 are made on a case that the humectant 36 is attached on the magazine cover 35 by the adhesive tape 37, and on a case that the casing 137 dedicated for storage is provided to store the humectant 141 therein. However, the present invention is not limited thereto.

For example, a dedicated case having a porous structure may be placed detachably on the upper portion of the magazine 31 so as to be charged with the humectant (e.g. 36, 141). That is, it is only necessary that a structure be employed to make it possible to place one of the humectants 36 and 141 at the upper portion of the magazine 31 and 131. In this case again, the advantage is the same as that of the photographic printing devices 1 and 101 according to the above-described first and second embodiments can be obtained.

(B)

In the photographic printing device 1 according to the above-described first embodiment, a description is made on a case that as one example of the adhesive member, the humectant 36 is attached on the magazine cover 35 with the adhesive tape 37. However, the present invention is not limited thereto.

As a means for pasting the humectant 36 onto the magazine cover 35, an adhesive and synthetic rubber with low hardness, for example, may be used. In this case again, it is possible to obtain the advantage the same as that of the photographic printing device 1 according to the above-described first embodiment.

(C)

In the photographic printing device 1 according to the above-described first embodiment, a description is made on a case that the humectant 36 is replaced by means of the openable and closable magazine cover. However, the present invention is not limited thereto.

For example, an openable and closable door for replacing the humectant 36 may be placed near the arrangement position of the humectant 36, and the humectant 36 may be replaced by means of the door. In this case again, it is possible to obtain the advantage the same as that of the photographic printing device 1 according to the above-described first embodiment.

(D)

In the photographic printing device 101 according to the above-described second embodiment, a description is made on a case that the casing 137 is placed on a part of the magazine cover 135. However, the present invention is not limited thereto.

It is only necessary that the casing 137 be positioned at the upper portion inside of the magazine 131 for accommodating the print sheet P. In this case again, it is possible to obtain the advantage the same as that of the photographic printing device 101 according to the above-described second embodiment.

(E)

In the photographic printing devices 1 and 101 according to the above-described first and second embodiments, a description is made on cases that the magazine set units 30 and 130 according to the present invention is mounted on the ink-jet printers 20 and 120 in the photographic printing devices 1 and 101. However, the present invention is not limited thereto.

For example, the recording paper magazines 30 and 130 according to the present invention may be mounted as a device for accommodating a recording medium for a heat-sensitive-paper-use printer and a photographing processing apparatus. In this case again, since the humidity conditions can be maintained at a constant one with respect to the heat-sensitive paper and the print sheet accommodated inside the recording paper magazines 30 and 130, if the heat-sensitive paper and the print sheet have characteristics of causing a fault in the low humidity environment, it is possible to obtain the advantage the same as that of the photographic printing devices 1 and 101 according to the above-described first and second embodiments.

(F)

In the photographic printing devices 1 and 101 according to the above-described first and second embodiments, a description is made on a case that the print sheet P having use conditions of humidity environment of 30% to 70% is utilized. However, the present invention is not limited thereto.

For example, if the print sheet P having a humidity condition of 40% to 70% is applied, the inside of the magazine for accommodating the print sheet P can be maintained at a predetermined condition by changing the kinds of the humectants 36 and 141 to be utilized. In this case again, it is possible to obtain the advantage the same as that of the photographic printing devices 1 and 101 according to the above-described first and second embodiments.

(G)

In the photographic printing devices 1 and 101 according to the above-described first and second embodiments, a description is made on a case that the print sheet is accommodated in the magazine. However, the present invention is not limited thereto.

For example, in order to accommodate the print sheet P inside the main body of the ink-jet printers 20 and 120, a sectioned space is provided inside the ink-jet printers 20 and 120, and the above-described invention may be applied to the space. In this case again, it is possible to obtain the advantage the same as that of the photographic printing devices 1 and 101 according to the above-described first and second embodiments.

INDUSTRIAL APPLICABILITY

According to the present invention, it becomes possible to easily assure the moisturized state inside the magazine, and therefore, it is more advantageous if the present invention is applied to the thermal printer and the photographing processing apparatus in which the recording paper accommodated in the magazine is a heat-sensitive paper, a printing paper, etc.

What is claimed is:

1. A recording paper magazine, comprising:

a housing configured and arranged to receive a recording paper therein with a first open and close member that is openable and closeable with respect to outside of the housing for replacement of recording paper in a recording paper space of the housing, the housing including a casing defining a humectant space smaller than and separate from the recording paper space formed in the housing, and the casing being formed at a part of an upper portion of the housing so as to be placed above recording paper accommodated in the housing; and a humectant placed in the humectant space defined by the casing at the upper portion of the housing in order to moisturize a space in the housing, the casing having a second open-and-close member that is openable and closeable with respect to outside of the housing to access the humectant space without opening the first open and close member, the second open and close member being smaller than the first open and close member, and the casing further having an aerated structure at a part facing the recording paper space inside of the housing.

2. A recording paper magazine according to claim 1, wherein the first open and close member is disposed on a top of the housing, with the casing being integrally formed on a part of the first open and close member.

3. An ink jet printer, comprising:

a recording paper magazine including a housing configured and arranged to receive a recording paper therein with a first open and close member that is openable and closeable with respect to outside of the housing for replacement of recording paper in a recording paper space of the housing, the housing including a casing defining a humectant space smaller than and separate from the recording paper space formed in the housing, and the casing being formed at a part of an upper portion of the housing so as to be placed above recording paper accommodated in the housing, and a humectant placed in the humectant space defined by the casing at the upper portion of the housing in order to moisturize a space in the housing, the casing having a second open-and-close member that is openable and closeable with respect to outside of the housing to access the humectant space without opening the first open and close member, the second open and close member being smaller than the first open and close member, and the casing further having an aerated structure at a part facing the recording paper space inside of the housing;

a conveyance path unit having a plurality of rollers configured and arranged to convey the recording paper; and a print unit configured and arranged to print an image on the recording paper, the recording paper magazine being placed at a position lower than the print unit.

4. The ink jet printer according to claim 3, wherein the first open and close member is disposed on a top of the housing, and the casing is integrally formed on a part of the first open and close member.

5. An ink jet printer, comprising:

a recording paper magazine including a housing configured and arranged to receive a recording paper therein with a first open and close member that is openable and closeable with respect to outside of the housing for replacement of recording paper in a recording paper space of the housing, the housing including a casing defining a humectant space smaller than and separate from the recording paper space formed in the housing, and the casing being formed at a part of an upper portion of the housing so as to be placed above recording paper accommodated in the housing, and a humectant placed in the humectant space defined by the casing at the upper portion of the housing in order to moisturize a space in the housing, the casing having a second open-and-close member that is openable and closeable with respect to outside of the housing to access the humectant space without opening the first open and close member, the second open and close member being smaller than the first open and close member, and the casing further having an aerated structure at a part facing the recording paper space inside of the housing;

a conveyance path unit having a plurality of rollers configured and arranged to convey the recording paper; and a print unit configured and arranged to print an image on the recording paper; and a direction change unit located upstream of the print unit, the direction change unit including a roller in the conveyance path unit around which a base surface of the recording paper opposite of a print surface is wound.

6. The ink jet printer according to claim 5, wherein the first open and close member is disposed on a top of the housing, and the casing is integrally formed on a part of the first open and close member.

* * * * *